US012800168B2

(12) United States Patent
Carlsson

(10) Patent No.: US 12,800,168 B2
(45) Date of Patent: Nov. 17, 2026

(54) DEHUMIDIFICATION SYSTEM

(71) Applicant: MUNTERS EUROPE AKTIEBOLAG, Kista (SE)

(72) Inventor: Magnus Carlsson, Vallentuna (SE)

(73) Assignee: Munters Europe Aktiebolag, Kista (SE)

( * ) Notice: Subject to any disclaimer, the term of this patent is extended or adjusted under 35 U.S.C. 154(b) by 89 days.

(21) Appl. No.: 17/642,473

(22) PCT Filed: Sep. 11, 2020

(86) PCT No.: PCT/SE2020/050854
§ 371 (c)(1),
(2) Date: Mar. 11, 2022

(87) PCT Pub. No.: WO2021/049998
PCT Pub. Date: Mar. 18, 2021

(65) Prior Publication Data

US 2022/0307710 A1 Sep. 29, 2022

(30) Foreign Application Priority Data

Sep. 13, 2019 (SE) ..... 1951038-7

(51) Int. Cl.
*F24F 11/83* (2018.01)
*F24F 3/14* (2006.01)
(Continued)

(52) U.S. Cl.
CPC ..... *F24F 11/0008* (2013.01); *F24F 3/1411* (2013.01); *F24F 3/153* (2013.01);
(Continued)

(58) Field of Classification Search
CPC ..... F24F 3/14; F24F 3/1411; F24F 3/1423; F24F 2003/1458; F24F 3/147; F24F 2003/1464
See application file for complete search history.

(56) References Cited

U.S. PATENT DOCUMENTS 6,370,900 B1 * 4/2002 Maeda ..... F24F 5/001 62/271
6,935,131 B1 8/2005 Backman
(Continued)

FOREIGN PATENT DOCUMENTS

CA 2 722 405 A1 10/2011
CN 101222967 A 7/2008
(Continued)

OTHER PUBLICATIONS

Extended European Search Report dated Nov. 28, 2022, in European Patent Application No. 20863061.6.
(Continued)

*Primary Examiner* — Marc E Norman
(74) *Attorney, Agent, or Firm* — Venable LLP

(57) ABSTRACT

A dehumidification system includes a sorption dehumidifier unit, a process air circuit arranged to conduct a process air flow through desiccant material in the dehumidifier unit, a regeneration air circuit arranged to conduct a regeneration air flow through desiccant material in the dehumidifier unit, a heat pump having an evaporator and a condenser, and an intermediate fluid circuit using a cooling fluid to cool the process air in a heat exchanger before inlet of the process air into the dehumidifier unit. The intermediate fluid circuit includes a fluid pump, a main conduit arranged to conduct the cooling fluid through the process air cooling heat exchanger and through the evaporator of the heat pump, and a flow control system arranged to control the flow of cooling fluid in the intermediate fluid circuit to obtain a cooling fluid
(Continued)

temperature dependent parameter value in the intermediate fluid circuit upstream of the process air cooling heat exchanger, which corresponds to a given set-point cooling fluid temperature dependent parameter value.

17 Claims, 4 Drawing Sheets

(51) Int. Cl.
*F24F 3/153* (2006.01)
*F24F 11/00* (2018.01)
*F24F 140/20* (2018.01)

(52) U.S. Cl.
CPC ..... *F24F 11/83* (2018.01); *F24F 2003/1446* (2013.01); *F24F 2003/1458* (2013.01); *F24F 2140/20* (2018.01)

(56) References Cited

U.S. PATENT DOCUMENTS

| | | | | |
|---|---|---|---|---|
| 9,021,818 | B2 | 5/2015 | Dalla Valle et al. | |
| 2003/0121271 | A1 | 7/2003 | Dinnage et al. | |
| 2005/0050906 | A1 | 3/2005 | Dinnage et al. | |
| 2006/0086120 | A1* | 4/2006 | Kashirajima | F24F 12/003 62/331 |
| 2007/0056307 | A1 | 3/2007 | Caggiano | |
| 2010/0192605 | A1 | 8/2010 | Fang et al. | |
| 2011/0271548 | A1* | 11/2011 | Park | F24F 3/14 34/526 |
| 2012/0023988 | A1* | 2/2012 | Togano | F24F 12/003 62/238.3 |
| 2012/0132070 | A1* | 5/2012 | Matsuba | B01D 53/06 96/110 |
| 2013/0298580 | A1 | 11/2013 | Dinnage | |
| 2015/0233597 | A1* | 8/2015 | Dempster | F24F 11/63 165/218 |
| 2017/0045242 | A1* | 2/2017 | Lee | F24D 15/04 |

FOREIGN PATENT DOCUMENTS

| | | | |
|---|---|---|---|
| CN | 101715533 | A | 5/2010 |
| CN | 101680675 | A | 8/2012 |
| CN | 102901159 | A | 1/2013 |
| JP | 9-133416 | A | 5/1997 |
| JP | 2004-278943 | A | 10/2004 |
| JP | 2005-233528 | A | 9/2005 |
| JP | 2009-208001 | A | 9/2009 |
| JP | 2012-159235 | A | 8/2012 |
| JP | 2013-94750 | A | 5/2013 |
| JP | 2015145000 | A * | 8/2015 |
| JP | 2017-101887 | A | 6/2017 |
| SE | 1751436 | A1 | 6/2019 |
| WO | 2007/022604 | A1 | 3/2007 |

OTHER PUBLICATIONS

English-language machine translation of JP 2004-278943.
English-language machine translation of JP 2009-208001.
English-language machine translation of JP 2012-159235.
English-language machine translation of JP 2015-145000.
International Search Report dated Oct. 22, 2020, in International Application No. PCT/SE2020/050854.
Office Action dated Apr. 25, 2023, in Indian Application No. 202247019723.
Office Action dated May 9, 2023, in European Application No. 20863061.6
Office Action dated Feb. 11, 2023, in Chinese Application No. 202080063595.9.
Examination Report dated Aug. 2, 2024 in European Patent Application No. 20863061.6.
Office Action dated Sep. 11, 2024, in Canadian Patent Application No. 3,153,956.
Office Action dated Oct. 24, 2024, in New Zealand Patent Application No. 785962.
Office Action dated Dec. 20, 2023, in Canadian Application No. 3,153,956.
Office Action dated Feb. 1, 2024, in Israel Patent Application No. 291237.
European Office Action and Search Report tdated Dec. 15, 2023, in European Patent Application No. 20863061.6.
Translation of Decision of Rejection dated Mar. 25, 2024 in Chinese Patent Application No. 202080063595.9.
Office Action dated May 28, 2024, in Japanese Patent Application No. 2022-513693.

* cited by examiner

DEHUMIDIFICATION SYSTEM

TECHNICAL FIELD

The present disclosure relates to a dehumidification system, and a method of operating the dehumidification system.

BACKGROUND ART

Dehumidifiers, such as sorption dehumidifiers and condensate dehumidifiers, are used for separating and removing moisture from air. A sorption dehumidifier typically comprises a dehumidifying element in the form of a wheel or rotor holding desiccant material, which is effective in attracting and retaining water vapor. The desiccant rotor may be divided in two sections, a process section and a regeneration section. The airflow to be dehumidified, process air, will pass through the process section of the desiccant rotor, and the desiccant material in the rotor extracts moisture from the process air, so that it can leave the rotor as dried air. Simultaneously, the desiccant material is regenerated by another air stream, which flows through the regeneration section, all the while the desiccant rotor may rotate slowly about its longitudinal axis. By means of the simultaneous dehumidification of the process air and regeneration of desiccant material, the dehumidifier can be operated continuously. US2007/0056307A1 discloses an example of a dehumidifier having a desiccant wheel.

For the regeneration process to be effective, the air stream used for regeneration of the desiccant material in the rotor needs to have a relatively high temperature, and will typically need to be heated. It may be advantageous to cool the process air prior to the dehumidifier inlet, in order to remove moisture due to cooling. The heat subtracted from the process air flow during cooling can be transferred to the regeneration air stream by the provision of a heat pump in the dehumidification system. US2005/0050906A1 shows an example of this, where process air is cooled by the evaporator of a heat pump prior to the dehumidifier inlet, and the regeneration air is heated by the condenser of the heat pump.

There is an ongoing interest in minimising the energy consumption of the dehumidification process, for economic reasons and for consideration of climate aspects, and in obtaining stable operation of the dehumidification unit.

SUMMARY OF THE INVENTION

The present invention aims at providing an energy effective dehumidification system, which allows for stable and reliable dehumidification of process air.

The dehumidification system of the invention comprises a sorption dehumidifier unit; a process air circuit arranged to conduct a process air flow through desiccant material in the dehumidifier unit; a regeneration air circuit arranged to conduct a regeneration air flow through the desiccant material in the dehumidifier unit; and a heat pump comprising an evaporator and a condenser. The system further comprises an intermediate fluid circuit with a cooling fluid (C), arranged to cool the process air in a heat exchanger before inlet of the process air into the dehumidifier unit, said intermediate fluid circuit comprising a fluid pump and a main conduit arranged to conduct cooling fluid (C) through the process air cooling heat exchanger and through the evaporator of the heat pump, and the intermediate fluid circuit further comprising a flow control system arranged to control the flow of cooling fluid (C) in the intermediate fluid circuit to obtain a cooling fluid temperature dependent parameter value (T1) in the intermediate fluid circuit upstream of the process air cooling heat exchanger, which corresponds to a given set-point cooling fluid temperature dependent parameter value ($T1_{set}$). The flow control system of the intermediate fluid circuit may preferably comprise a control unit (CU) arranged to control the flow of cooling fluid in the intermediate fluid circuit by controlling the fluid pump and/or one or more fluid control valves arranged in the intermediate fluid circuit. The intermediate fluid circuit preferably comprises a bypass conduit allowing a part of the cooling fluid (C) to bypass the process air cooling heat exchanger.

The cooling fluid temperature dependent parameter is preferably the cooling fluid temperature, and the given set-point value ($T1_{set}$) for the cooling fluid preferably is set to a temperature below 10° C., more preferably below 5° C., most preferably below 0.5° C. The process air cooling heat exchanger is advantageously dimensioned to cool the process air at the process air inlet of the dehumidifier unit to a given constant air inlet temperature value (T2), said air inlet temperature value (T2) preferably being below 10° C.

The regeneration air circuit is preferably connected to the condenser of the heat pump upstream of the dehumidifier unit. The intermediate fluid circuit preferably comprises a heat exchanger arranged upstream of the heat pump evaporator to cool the regeneration air downstream of the dehumidifier unit. The regeneration air circuit may comprise an electrical heater upstream of the dehumidifier unit, arranged to optionally heat the regeneration air if needed.

The flow control system is advantageously arranged to control the flow of cooling liquid in the intermediate fluid circuit so that the heat subtracted from the process air in the process air cooling heat exchanger and from the regeneration air in the regeneration air heat exchanger substantially corresponds to the heat required to be transferred to the regeneration air in the condenser of the heat pump in order to reach a given temperature (T3) at the regeneration air inlet of the dehumidifier unit.

The present invention also relates to a method of operating the above dehumidification system, comprising the steps of a) determining an actual cooling fluid temperature dependent parameter value (T1) upstream of the process air cooling heat exchanger; and b) if the actual cooling fluid temperature dependent parameter value (T1) deviates from the given set-point cooling fluid temperature dependent parameter value ($T1_{set}$), adjusting the flow of cooling fluid (C) in the intermediate fluid circuit (8) by adjusting the flow capacity of the fluid pump (11) and/or the one or more fluid control valves arranged in the intermediate fluid circuit; and c) repeating steps a) and b) until $T1=T1_{set}$.

The present invention also relates to a computer program for operating the above dehumidification system, comprising instructions which, when executed on at least one processor, causes the at least one processor to carry out the above method. The present invention also relates to a computer-readable storage medium carrying the computer program for operating the dehumidification system.

BRIEF DESCRIPTION OF THE DRAWINGS

The present dehumidification system is described herein with reference to the drawings, wherein.

DETAILED DESCRIPTION

The present dehumidification system is described herein with reference to the schematic drawings, which illustrate examples of systems according to the invention.

Figure 1:
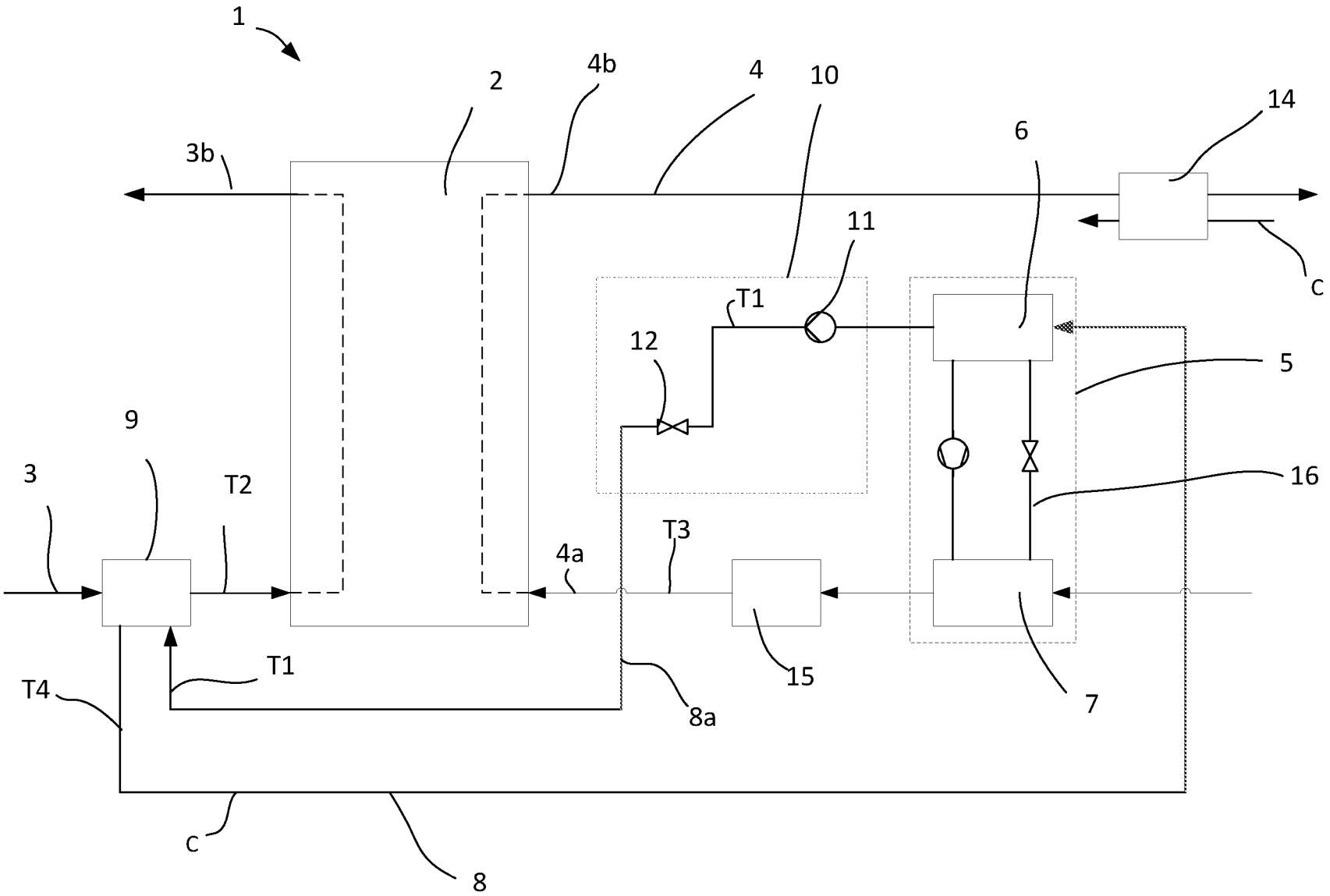
FIG. 1 illustrates a first example of the dehumidification system comprising an intermediate fluid circuit which is used to control the cooling fluid temperature upstream of an inlet process air cooling heat exchanger.

As shown in FIG. 1, the dehumidification system (1) of the invention comprises a sorption dehumidifier unit (2), a process air circuit (3) arranged to conduct a process air flow through desiccant material in the dehumidifier unit, and a regeneration air circuit (4) arranged to conduct a regeneration air flow through the desiccant material in the dehumidifier unit. The system also comprises a heat pump (5) comprising an evaporator (6) and a condenser (7), by means of which heat can be transferred between streams within the system. The dehumidification system further comprises an intermediate fluid circuit (8) with a circulating fluid, herein referred to as the cooling fluid (C), arranged to cool the process air in a heat exchanger (9) before inlet of the process air into the dehumidifier unit. By cooling the process air upstream of the dehumidifier unit the moisture content can be reduced already before entry into the dehumidification unit, whereby less energy is needed for the dehumidification process in the dehumidifier unit.

The intermediate fluid circuit also comprises a fluid pump (11) and a main conduit (8*a*) arranged to conduct the cooling fluid (C) through the process air cooling heat exchanger (9) and through the evaporator (6) of the heat pump. A fluid control valve (12) may suitably be arranged in the main conduit (8*a*). The intermediate fluid circuit also comprises a flow control system (10) arranged to control the flow of cooling fluid (C) in the intermediate fluid circuit to obtain a cooling fluid temperature dependent parameter value (T1) in the intermediate fluid circuit upstream of the process air cooling heat exchanger, which corresponds to a given set-point cooling fluid temperature dependent parameter value (T1set). By means of the intermediate fluid circuit, the process air is not cooled directly by the heat pump evaporator, but indirectly via the cooling fluid (C), and the flow control system allows control of the temperature of the cooling fluid entering the process air cooling heat exchanger. It is thus possible to ensure that the cooling fluid temperature is kept at a controlled level, whereby the risk of frost formation in the process air cooling heat exchanger can be avoided. It is important to avoid frost in the heat exchanger, since it can lead to ice build-up, which can impede the air flow through the heat exchanger and impair the heat transfer, and make the system difficult to control.

The parameter to be measured and controlled by the flow control system can be any fluid parameter that varies with the fluid temperature, such as temperature, density, viscosity, etc., where the fluid temperature is preferred, since it is a parameter which is convenient to measure. For the sake of simplicity, the cooling fluid temperature dependent parameter is referred to as the cooling fluid temperature below, although it could be any temperature dependent parameter.

The given set-point value (T1set) for the cooling fluid temperature is preferably set to a temperature below 10° C., more preferably below 5° C., most preferably below 0.5° C. The lower the cooling fluid temperature is, the more effective cooling of the process air in the process air cooling heat exchanger. Depending on the construction of the process air cooling heat exchanger, a lowest value for the given set-point value (T1set) for the cooling fluid temperature can be close to 0° C. or below 0° C. A cooling fluid temperature slightly above 0° C., such as, e.g., 0.1° C., allows for the use of more simple counter-current heat-exchangers, whereas a cooling fluid temperature below 0° C. may require a more complicated heat exchanger construction. The cooling fluid of the intermediate fluid circuit is a liquid, and remains in liquid state at all times, and it is suitably water, optionally comprising an amount of a freezing-point depressing additive. It is referred to as "the cooling fluid" since it is used to cool the incoming process air upstream of the process air inlet of the dehumidifier unit, but it acts as a heating fluid in the evaporator of the heat pump.

The process air cooling heat exchanger (9) is advantageously dimensioned to cool the process air upstream of the process air inlet of the dehumidifier unit to a given constant air inlet temperature value (T2). This means that the heat exchanger is dimensioned so that, regardless of the properties of the process air entering the process air cooling heat exchanger (9), the process air temperature T2 downstream the heat exchanger will be the same at all times. Thereby, process air cooling heat exchanger (9) may be somewhat over-dimensioned at some points in time. A predetermined constant temperature of the process air entering the dehumidification unit can improve the dehumidification process, since the dehumidification unit can be optimized for inlet process air having certain predictable properties, and the operation of the dehumidification process will be stable. The process air temperature value (T2) upstream of the dehumidification unit will be dependent on the given set-point value (T1set) for the cooling fluid temperature upstream of the process air cooling heat exchanger (9), and is preferably as low as possible, preferably below 10° C., and suitably above 0° C. Measurement of temperature dependent parameters in a fluid flow is stable and reliable, as compared to measuring similar parameters in an air flow, and controlling the dehumidification system based on the cooling fluid temperature (T1) upstream of the process air cooling heat exchanger (9) therefore leads to stable operation of the system.

The properties of the process air entering the dehumidification system, such as humidity and temperature, can vary substantially from time to time. In particular if the process air is ambient air taken from outdoors, these properties can vary largely due to seasonal variations and time of the day, and this can be particularly significant in certain geographical regions. However, also if the process air is taken from a confined space, such an industrial building, the properties can vary depending on various circumstances, such as the activities performed in the building, and the weather variations outside the building. Therefore, in order to obtain a constant temperature of the process air upstream of the dehumidifier unit, the process air cooling heat exchanger (9) will need to be dimensioned according to the specific circumstances of the site where the system is implemented.

The cooling fluid temperature (T1) upstream of the process air cooling heat exchanger (9) is controlled by adjustment of the flow of cooling fluid in the intermediate fluid circuit. In order to achieve this, the flow control system of the intermediate fluid circuit suitably comprises a control unit (CU) arranged to control the flow of cooling fluid in the intermediate fluid circuit (8) by controlling the fluid pump (11) and/or one or more fluid control valves (12, 13) arranged in the intermediate fluid circuit. The fluid pump may suitably have a variable frequency drive to allow control of the flow capacity of the pump, and/or one or more fluid control valves can be opened or closed as needed to obtain the cooling flow needed to keep the cooling fluid temperature (T1) at the set value (T1set). The flow of cooling fluid in the main conduit (8*a*) is at least partly indirectly controlled based on the need of cooling capacity in the process air cooling heat exchanger (9). If the temperature (T1) of cooling fluid upstream of the process air cooling heat exchanger (9) exceeds the set value (T1set), this will be detected by the control unit (CU), which will act on the fluid pump and/or the one or more fluid control valves to decrease the flow in the main conduit (8*a*), until the cooling fluid temperature (T1) has returned to the set value (T1set), and vice versa, if the temperature (T1) falls below the set value (T1set), the flow in the main conduit (8*a*) will increase.

Figure 2:
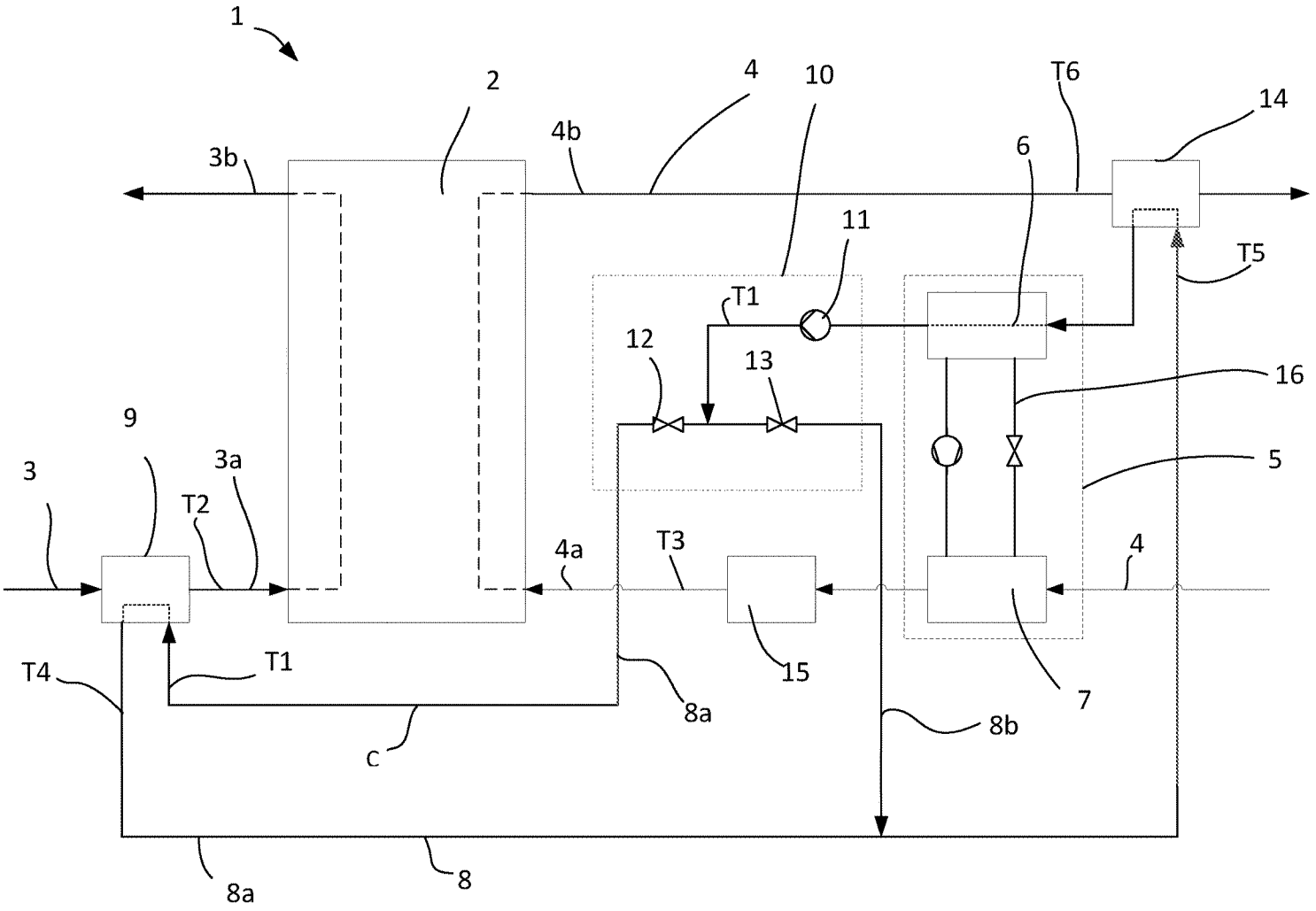
FIG. 2 illustrates a second example of the dehumidification system, wherein the cooling fluid of the intermediate fluid circuit collects heat from outlet regeneration air downstream of the dehumidification unit.

The intermediate fluid circuit may preferably comprise a bypass conduit (8*b*), suitably provided with a fluid control valve (13), allowing a part of the cooling fluid (C) to bypass the process air cooling heat exchanger (9), as shown in FIG. 2. This increases the flexibility of the dehumidification system, since the cooling fluid flow in the main conduit (8*a*) of the intermediate fluid circuit can be controlled both by adjusting the flow capacity of the pump (11) and/or the fluid control valve (12) in the main conduit, and by letting a part of the cooling fluid flow bypass the heat exchanger (9) through the bypass conduit (8*b*), e.g., by opening the fluid control valve (13). The fluid control valves (12, 13) in the main conduit and the bypass conduit can of course be replaced by a three-way valve if desired.

As noted above, the dehumidification system comprises a regeneration air circuit (4) arranged to conduct a regeneration air flow through the desiccant material in the dehumidifier unit (2). The dehumidifier unit can be of any type suitable for dehumidification of process air by means of desiccant material and regeneration air. For example, the sorption dehumidifier (2) can suitably comprise a dehumidifying element in the form of a rotor holding desiccant material, e.g., silica gel, which is effective in attracting and retaining water vapor. The desiccant rotor may be divided in two sections, a dehumidification section and a regeneration section. The process air (3) to be dehumidified will pass through the dehumidification section of the desiccant rotor, in which the desiccant material in the rotor extracts moisture from the process air, so that it can leave the rotor as dried air (3*b*). Simultaneously, the moisture-laden desiccant material is regenerated in a regeneration section, where the moisture is transferred to the regeneration air stream (4), which flows through the regeneration section, all while the desiccant rotor rotates slowly. By means of the simultaneous dehumidification of the process air and regeneration of desiccant material, the dehumidifier unit (2) can be operated continuously. Other configurations of the dehumidifier unit can be contemplated, for example, comprising multiple rotors holding desiccant material, rotors having more than two sections, and/or in which one or both of the process air flow and the regeneration air flow are divided in multiple air streams within the dehumidifier unit. The dehumidifier unit need not necessarily be a single process unit, but can be comprised of multiple steps or sections in series or parallel.

For the regeneration process to be effective, the air stream used for regeneration of the desiccant material in the rotor needs to have a relatively high temperature, and will typically need to be heated. In the dehumidification system of the present disclosure, the regeneration air circuit (4) can preferably be connected to the condenser (7) of the heat pump, upstream of the dehumidifier unit. This means that heat subtracted from the cooling fluid (C) in the heat pump evaporator (6) can be transferred to the inlet regeneration air (4*a*), via the refrigerant circuit (16) of the heat pump and the condenser, i.e. heat subtracted from the process air (3) in the air cooling heat exchanger (9) can be utilized for heating the inlet regeneration air (4*a*), via the intermediate fluid circuit (8) and the refrigerant circuit (16) of the heat pump (5). An electrical heater (15) may be comprised in the regeneration air circuit (4) upstream of the dehumidifier unit, arranged to optionally heat the inlet regeneration air (4*a*) if needed.

When the regeneration air leaves the dehumidification unit outlet (4*b*), it has higher moisture content and lower temperature than at the dehumidification unit inlet (4*a*). The outlet regeneration air may be released to the surroundings, but since it typically may have a temperature substantially higher than the ambient temperature, it may be advantageous to recover at least some of the heat to the process. A heat exchanger (14) is therefore suitably arranged on the outlet regeneration air flow to allow recovery of heat held therein. The heat exchanger (14) is preferably incorporated into the intermediate fluid circuit (8), and is then preferably arranged in the intermediate fluid circuit (8) upstream of the heat pump evaporator (6) so as to cool the regeneration air (4*b*) downstream of the dehumidifier unit, thus extracting heat from the regeneration air flow (4*b*). When the temperature of the regeneration air decreases during cooling in the heat exchanger (14), the moisture content in the air flow decreases due to condensation, and if desired the outlet regeneration air (4*b*) can be returned to the regeneration air circuit (4), optionally after further removal of moisture, as regeneration inlet air (4*a*), so that the regeneration air circuit (4) is a closed circuit.

The heat subtracted from the regeneration air (4*b*) in the heat exchanger (14) can thus be utilized to heat the inlet regeneration air (4*a*) by means of the heat pump (5). In the heat exchanger (14), the heat of the regeneration air is suitably transferred to a cooling fluid, which may preferably be the cooling fluid (C) of the intermediate fluid circuit, as mentioned above, or a partial flow thereof, as shown in FIG. 2.

With the regeneration air circuit (4) connected to the condenser (7) of the heat pump, upstream of the dehumidification unit, heat can thereby be transferred from the outlet regeneration air (4*b*) via the intermediate fluid circuit (8) and the refrigerant circuit (16) to the inlet regeneration air (4*a*).

An outlet regeneration air heat exchanger (14) as described above can be particularly useful in situations where the heat transferred in the process air cooling heat exchanger (9), i.e., from the inlet process air (3) to the fluid (C) of the intermediate fluid circuit, does not match the energy requirement of the heat pump evaporator (6) needed to sufficiently heat the inlet regeneration air (4) in the heat pump condenser (7). Such situations may be for example when the temperature of the process air (3) entering the process air cooling heat exchanger (9) is low or when the outlet process air (3*b*) needs to be extra dry (e.g., dew point below −20° C.), which may be the case in certain industrial processes. The outlet regeneration air heat exchanger (14) can then provide additional heating of the cooling fluid (C) in the intermediate fluid circuit, since the temperature (T6)

of the outlet regeneration air is typically substantially higher than the temperature (T4) of the cooling fluid (C) leaving the process air cooling heat exchanger (9).

Figure 3:
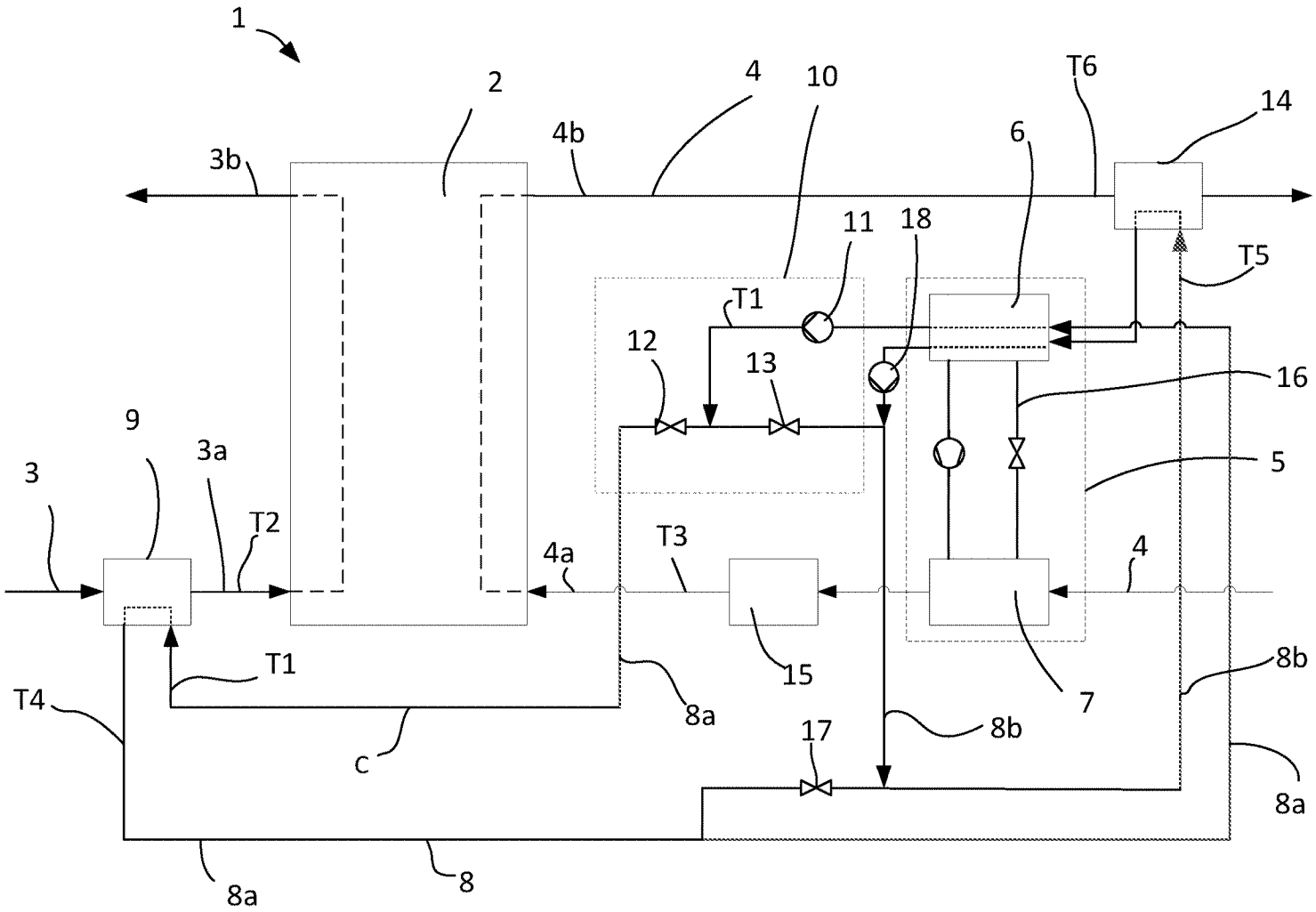
FIG. 3 illustrates a third example of the dehumidification system, wherein the intermediate fluid circuit is arranged to provide a separate cooling fluid flow through the outlet regeneration air cooling heat exchanger.

When an outlet regeneration air heat exchanger (14) is arranged in the dehumidification system, the above mentioned bypass conduit (8*b*) allows the possibility to conduct a partial flow of the cold cooling fluid (C) downstream of the evaporator (6) directly to the regeneration air heat exchanger (14), whereby the temperature difference between the cooling fluid (C) (T5) and the regeneration air (T6) entering the heat exchanger (14) will be larger. The intermediate fluid circuit can be arranged so that a separate flow of cooling fluid (C) can be conducted between the heat exchanger (14) and the heat pump evaporator (6) to transfer the heat from the regeneration air (4*b*) to the refrigerant circuit (16) of the heat pump. This can be obtained, for example, by arranging the bypass flow conduit (8*b*) so that it conducts cold cooling fluid (C) directly from the evaporator (6) to the outlet regeneration air heat exchanger (14), as shown in FIG. 3, thereby achieving a maximum temperature difference between the outlet regeneration air (T6) and the cooling fluid (T5). If the fluid control valve (13) is closed, so that the bypass flow conduit (8*b*) is not used, the cooling fluid temperature (T4) after the process air cooling heat exchanger (9) will be the same as the cooling fluid temperature (T5) before the outlet regeneration air heat exchanger (14).

As shown in FIG. 3, second fluid pump (18) can be provided in the bypass flow conduit (8*b*) to allow independent flow control in this part of the intermediate fluid circuit, and further connecting conduits and valves (13, 17) can be arranged, so that the flows of the main conduit (8*a*) and the bypass conduit (8*b*) can be combined as desired, which gives an increased flexibility to the dehumidification system.

Various heat pump arrangements are available in the art, and the components thereof, such as the evaporator and condenser, are chosen in accordance with the selected set up for the intermediate fluid circuit. Thus, different constructions of evaporators and condensers may be suitable, and it is also contemplated that multiple units of evaporators and/or condensers may be used, arranged in series or parallel. The same applies to the heat exchangers (9, 14) for cooling inlet process air (3*a*) and outlet regeneration air (4*b*), where various heat exchanger designs and multiple units can be used as desired.

The flow control system (10) is advantageously arranged to control the flow of cooling liquid (C) in the intermediate fluid circuit (11) so that the heat subtracted from the inlet process air (3*a*) in the process air cooling heat exchanger (9) and from the outlet regeneration air (4*b*) in the regeneration air heat exchanger (14) substantially corresponds to the heat required to be transferred to the inlet regeneration air (4*a*) in the condenser (7) of the heat pump in order to reach a given temperature (T3) at the regeneration air inlet of the dehumidifier unit (2), so as to substantially eliminate the need of additional heating by means of the electrical heater (15).

The flow control system preferably includes, in addition to the control unit (CU), a measuring equipment for determining the cooling fluid temperature dependent parameter, suitably arranged in the system in the flow conduit (8*a*) between the pump (11) and the process air cooling heat exchanger (9). Means are provided for forwarding information of the determined parameter value (T1) to the control unit (CU), which is arranged to compare the determined parameter value (T1) with a given set-point cooling fluid temperature dependent parameter value ($T1_{set}$) of the cooling fluid, and means are provided for acting on the fluid pump(s) (11, 18) and/or one or more of the fluid control valves (12, 13, 17) to adjust the cooling fluid flow in the different parts of the intermediate fluid circuit based on the value (T1).

Schematic illustrations of examples of the dehumidification system are shown if FIGS. 1-3. FIG. 1 illustrates a first example of the dehumidification system (1) comprising an intermediate fluid circuit (11) which is used to control the cooling fluid temperature upstream of an inlet process air cooling heat exchanger. The heating of inlet regeneration air (4*a*) by the heat pump condenser (7) is also shown. In the second example, illustrated in FIG. 2, the cooling fluid of the intermediate fluid circuit collects heat from outlet regeneration air downstream of the dehumidification unit. FIG. 3 illustrates a third example of the dehumidification system, wherein the intermediate fluid circuit is arranged to provide a separate cooling fluid flow through the outlet regeneration air cooling heat exchanger.

Figure 4:
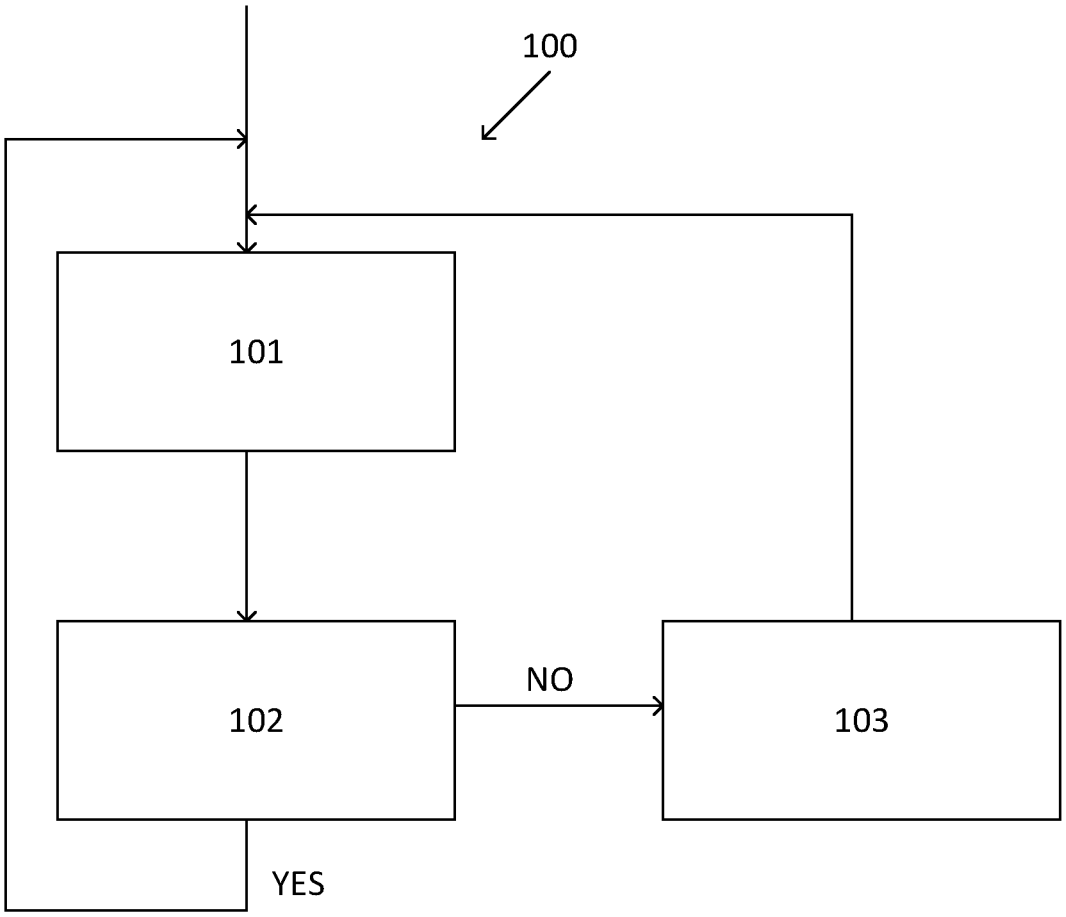
FIG. 4 is a schematic illustration of a method of operating the dehumidification system.

As illustrated in FIG. 4, the present invention also relates to a method (100) of operating the above dehumidification system, comprising the steps of a) detecting (101) the actual cooling fluid temperature dependent parameter value (T1) upstream of the process air cooling heat exchanger (9); and b) comparing (102) the value (T1) with the given set-point value ($T1_{set}$), and if the actual cooling fluid temperature dependent parameter value (T1) deviates (NO) from the given set-point cooling fluid temperature dependent parameter value ($T1_{set}$), adjusting (103) the flow of cooling fluid (C) in the intermediate fluid circuit (8) by adjusting the flow capacity of the fluid pump (11) and/or the one or more fluid control valves (12, 13) arranged in the intermediate fluid circuit; and c) repeating steps a) and b) until $T1=T1_{set}$ (YES).

The method is preferably performed by a computer program for operating the above dehumidification system, comprising instructions which, when executed on at least one processor, causes the at least one processor to carry out the above method. The present invention also relates to a computer-readable storage medium carrying the computer program for operating the dehumidification system.

It should be noted that the examples shown in the drawings are for illustrating purposes only, and many other alternatives may be contemplated within the scope of the present invention.

The invention claimed is:

1. A dehumidification system comprising:

a sorption dehumidifier unit having a process air inlet;

a process air circuit arranged to conduct a process air flow through desiccant material in the sorption dehumidifier unit;

a regeneration air circuit arranged to conduct a regeneration air flow through desiccant material in the sorption dehumidifier unit;

a heat pump comprising an evaporator and a condenser;

an intermediate fluid circuit with a cooling fluid, the intermediate fluid circuit being arranged to cool the process air in a process air cooling heat exchanger before inlet of the process air into the sorption dehumidifier unit, the intermediate fluid circuit comprising a fluid pump and a main conduit arranged to conduct the cooling fluid through the process air cooling heat exchanger and through the evaporator of the heat pump, and the intermediate fluid circuit further comprising a flow control system arranged to control the flow of the cooling fluid in the intermediate fluid circuit; and a controller for controlling the flow control system so that a cooling fluid temperature dependent parameter value (T1) in the intermediate fluid circuit upstream of the process air cooling heat exchanger becomes substantially equal to a given set-point cooling fluid temperature dependent parameter value ($T1_{set}$) so that the process air, before inlet of the process air into the sorption dehumidifier unit, is cooled to a temperature value (T2) corresponding to the cooling fluid temperature dependent parameter value (T1), wherein the process air cooling heat exchanger is dimensioned to cool the process air upstream of the process air inlet of the sorption dehumidifier unit such that the temperature value (T2) is a constant value regardless of the properties of the process air entering the process air cooling heat exchanger, and wherein the controller is configured to adjust the flow of the cooling fluid based on a comparison of an actual detected value of the cooling fluid temperature dependent parameter value (T1) relative to the set-point cooling fluid temperature dependent parameter value (T1set) to stabilize the process air temperature value (T2) at the constant value.

2. The dehumidification system of claim 1, wherein the intermediate fluid circuit comprises a bypass conduit allowing a part of the cooling fluid to bypass the process air cooling heat exchanger.

3. The dehumidification system of claim 1, wherein the cooling fluid temperature dependent parameter (T1) is the cooling fluid temperature, and the given set-point cooling fluid temperature dependent parameter value ($T1_{set}$) for the cooling fluid preferably is set to a temperature below 10° C.

4. The dehumidification system of claim 1, wherein the process air cooling heat exchanger is dimensioned to cool the process air upstream of the process air inlet of the sorption dehumidifier unit to the temperature value (T2) as the constant value, the temperature value (T2) preferably being below 10° C.

5. The dehumidification system of claim 1, wherein the regeneration air circuit is connected to the condenser of the heat pump upstream of the sorption dehumidifier unit.

6. The dehumidification system of claim 1, wherein the intermediate fluid circuit comprises a regeneration air heat exchanger arranged upstream of the heat pump evaporator to cool the regeneration air downstream of the sorption dehumidifier unit.

7. The dehumidification system of claim 6, wherein the flow control system is arranged to adjust the flow of cooling liquid in the intermediate fluid circuit so that heat subtracted from the process air in the process air cooling heat exchanger and from the regeneration air in the regeneration air heat exchanger substantially corresponds to heat required to be transferred to the regeneration air in the condenser of the heat pump in order to reach a given temperature at the regeneration air inlet of the sorption dehumidifier unit.

8. The dehumidification system of claim 1, wherein the regeneration air circuit comprises an electrical heater upstream of the sorption dehumidifier unit, arranged to optionally heat the regeneration air.

9. The dehumidification system of claim 1, wherein the controller adjusts the flow of cooling fluid in the intermediate fluid circuit by controlling the fluid pump and/or one or more fluid control valves arranged in the intermediate fluid circuit.

10. A method of operating the dehumidification system of claim 9, comprising the steps of:

a) determining an actual value of the cooling fluid temperature dependent parameter value (T1) upstream of the process air cooling heat exchanger; and b) if the actual value of the cooling fluid temperature dependent parameter value (T1) deviates from the given set-point cooling fluid temperature dependent parameter value ($T1_{set}$), adjusting the flow of cooling fluid in the intermediate fluid circuit by adjusting a flow capacity of the fluid pump and/or the one or more fluid control valves arranged in the intermediate fluid circuit; and c) repeating steps a) and b) until $T1=T1_{set}$.

11. The dehumidification system of claim 1, wherein the cooling fluid temperature dependent parameter value (T1) is the cooling fluid temperature, and the given set-point cooling fluid temperature dependent parameter value (T1set) for the cooling fluid preferably is set to a temperature below 5° C.

12. The dehumidification system of claim 1, wherein the cooling fluid temperature dependent parameter value (T1) is the cooling fluid temperature, and the given set-point cooling fluid temperature dependent parameter value (T1set) for the cooling fluid preferably is set to a temperature below 0.5° C.

13. The dehumidification system of claim 1, wherein the cooling fluid temperature dependent parameter value (T1) is the cooling fluid temperature.

14. The dehumidification system of claim 1, wherein the cooling fluid temperature dependent parameter value (T1) and the set-point cooling fluid temperature dependent parameter value ($T1_{set}$) are controlled so that the process air, before inlet of the process air into the sorption dehumidifier unit, is cooled to the temperature value (T2) within a predetermined range.

15. The dehumidification system of claim 14, wherein the predetermined range is below 10° C.

16. A non-transitory computer-readable storage medium storing a computer program for operating a dehumidification system, comprising instructions which, when executed on at least one processor, causes the at least one processor to carry out the method according to claim 10.

17. A dehumidification system comprising:

a sorption dehumidifier unit unit having a process air inlet;

a process air circuit arranged to conduct a process air flow through desiccant material in the sorption dehumidifier unit;

a regeneration air circuit arranged to conduct a regeneration air flow through desiccant material in the sorption dehumidifier unit;

a heat pump comprising an evaporator and a condenser;

an intermediate fluid circuit with a cooling fluid, the intermediate fluid circuit being arranged to cool the process air in a process air cooling heat exchanger before inlet of the process air into the sorption dehumidifier unit, the intermediate fluid circuit comprising a fluid pump and a main conduit arranged to conduct the cooling fluid through the process air cooling heat exchanger and through the evaporator of the heat pump, and the intermediate fluid circuit further comprising a flow control system arranged to control the flow of the cooling fluid in the intermediate fluid circuit, and a controller for controlling the flow control system so that a cooling fluid temperature dependent parameter value (T1) in the intermediate fluid circuit upstream of the process air cooling heat exchanger becomes substantially equal to a given set-point cooling fluid temperature dependent parameter value (T1set) so that the process air, before inlet of the process air into the sorption dehumidifier unit, is cooled to a temperature value (T2) corresponding to the cooling fluid temperature dependent parameter value (T1), wherein the process air cooling heat exchanger is dimensioned to cool the process air upstream of the process air inlet of the sorption dehumidifier unit such that the temperature value (T2) is a constant value regardless of the properties of the process air entering the process air cooling heat exchanger, and wherein the controller is configured to adjust the flow of the cooling fluid based on a comparison of an actual detected value of the cooling fluid temperature dependent parameter value (T1) detected by measuring equipment arranged in the main conduit upstream of the process air cooling heat exchanger relative to the given set-point cooling fluid temperature dependent parameter value (T1set) to stabilize the process air temperature (T2) at the constant value.

* * * * *